US010744051B2

(12) United States Patent
Virgo et al.

(10) Patent No.: US 10,744,051 B2
(45) Date of Patent: Aug. 18, 2020

(54) MOBILITY DEVICE

(71) Applicants: Carolyn Virgo, Los Angeles, CA (US); Steven Montgomery, Los Angeles, CA (US); Robert Shuman, Granada Hills, CA (US)

(72) Inventors: Carolyn Virgo, Los Angeles, CA (US); Steven Montgomery, Los Angeles, CA (US); Robert Shuman, Granada Hills, CA (US)

( * ) Notice: Subject to any disclaimer, the term of this patent is extended or adjusted under 35 U.S.C. 154(b) by 0 days.

(21) Appl. No.: 16/158,796

(22) Filed: Oct. 12, 2018

(65) Prior Publication Data

US 2019/0142666 A1 May 16, 2019

Related U.S. Application Data

(60) Provisional application No. 62/639,810, filed on Mar. 7, 2018, provisional application No. 62/584,319, filed on Nov. 10, 2017.

(51) Int. Cl.
*A61G 5/14* (2006.01)
*A61H 3/04* (2006.01)
(Continued)

(52) U.S. Cl.
CPC ..... *A61G 5/14* (2013.01); *A61H 3/04* (2013.01); *A61G 5/1029* (2013.01);
(Continued)

(58) Field of Classification Search
CPC ..... A61G 7/1038; A61G 7/104; A61G 5/14; A61G 5/1029; A61G 5/1013
See application file for complete search history.

(56) References Cited

U.S. PATENT DOCUMENTS 267,680 A 11/1882 Crandall
2,989,114 A 6/1961 Ecroyd
(Continued)

OTHER PUBLICATIONS amazon.com, Jun. 8, 2018, Internet printout: https://www.amazon.com/081561661-Lightweight-Aluminum-Rollator-Stabilizer/dp/B0754R8V6B.

(Continued)

*Primary Examiner* — David R Dunn
*Assistant Examiner* — Danielle Jackson
(74) *Attorney, Agent, or Firm* — Todd R. Miller

(57) ABSTRACT

Novel mobility devices are disclosed wherein one embodiment comprises a support frame and one or more boosters coupled to the frame. The booster preferably comprises a housing, a top support extending upward from the housing, and an opposing bottom support extending downward from the housing. The bottom support is preferably biased toward the housing. The housing may contain a sleeve having a top channel in communication with an opposing bottom channel. The top channel is configured to receive the top support, whereas the bottom channel is configured to receive the bottom support, a retaining ring, and a spring. The spring is disposed between a floor of the bottom channel and the retaining ring. The sleeve may also have a socket configured to receive a roller, wherein the roller has a bottom hole configured to receive the top support. The device permits the user to stand from a seated position or vice versa without the assistance of a third party, grab hold of handlebars extending from the frame, and then move about with independence. The device may also be folded for ease of storage.

18 Claims, 17 Drawing Sheets

(51) Int. Cl.
*A61G 5/10* (2006.01)
*A61G 7/10* (2006.01)

(52) U.S. Cl.
CPC ..... *A61G 5/1035* (2013.01); *A61G 7/1038* (2013.01); *A61G 7/1046* (2013.01); *A61H 2003/046* (2013.01)

(56) References Cited

U.S. PATENT DOCUMENTS 3,117,653 A * 1/1964 Altherr ..... B62B 5/04 188/29
3,288,250 A * 11/1966 Oja ..... A61G 5/101 188/5
3,633,906 A 11/1972 Fowler
3,739,793 A 6/1973 Wilson
3,889,964 A * 6/1975 Pitts, Jr. ..... A61G 5/1029 280/43.24
4,917,126 A * 4/1990 Ellmore ..... A61H 3/02 135/69
4,995,628 A * 2/1991 Orpwood ..... A61G 5/14 280/304.1
5,375,911 A 12/1994 Morrow
5,586,957 A 12/1996 Wilkinson
5,647,602 A * 7/1997 Nevin ..... A61H 3/04 135/67
5,788,608 A 8/1998 Wilkinson
6,056,673 A 5/2000 Arrecis
6,082,384 A * 7/2000 Cheng ..... A61H 3/00 135/66
6,454,285 B1 * 9/2002 Koenig ..... A61G 5/14 188/2 F
7,229,101 B2 6/2007 Lenhart
9,089,194 B2 * 7/2015 Tessier ..... A45B 1/00
2004/0011393 A1 * 1/2004 Whitworth ..... A61H 3/02 135/69
2010/0170548 A1 6/2010 Lenhart
2019/0247263 A1 * 8/2019 Liu ..... A61H 3/02

OTHER PUBLICATIONS arthritissupplies.com, Oct. 24, 2017, Internet printout: https://www.arthritissupplies.com/sitting-and-standing-devices.html.

* cited by examiner

MOBILITY DEVICE

CROSS-REFERENCE TO RELATED APPLICATIONS

The present application claims benefit of and priority to U.S. Provisional Patent Application Ser. No. 62/639,810 filed on Mar. 7, 2018, and U.S. Provisional Patent Application Ser. No. 62/584,319 filed on Nov. 10, 2017. Each application is incorporated by reference as if fully set forth herein.

BACKGROUND

The present disclosure relates generally to mobility aids for the frail, elderly, overweight, or otherwise infirm, and particularly to devices designed to maintain independence when rising from a seated position or vice versa, as well as designed to increase overall freedom of movement for the user.

SUMMARY

One exemplary embodiment of the disclosed subject matter is a mobility device comprising a support frame and one or more boosters coupled to the frame. The booster preferably comprises a housing, a top support extending upward from the housing, and an opposing bottom support extending downward from the housing. The bottom support is biased toward the housing when in a neutral position, as discussed in detail below.

The housing may contain a sleeve having a top channel in communication with an opposing bottom channel. The top channel is configured to receive the top support, whereas the bottom channel is configured to receive the bottom support, a retaining ring, and a spring. The spring is preferably disposed between a floor of the bottom channel and the retaining ring. The sleeve may also have a socket configured to receive a roller, wherein the roller has a bottom hole configured to receive the top support. This mobility device permits the user to stand from a seated position or vice versa by way of the one or more boosters without the assistance of a third party, grab hold of handlebars extending from the support frame, and then move about with independence. The mobility device may also be conveniently folded for ease of storage or transport.

Another exemplary embodiment of the disclosed subject matter is a mobility device comprising a support frame and a rocking bar pivotally mounted to the frame. The support frame may comprise a left front leg, an opposing right front leg, a left rear leg, and an opposing right rear leg. The rocking bar may be generally U-shaped and preferably mounted to the support frame's rear legs. The rocking bar is preferably bent at an obtuse angle to support a user's hands generally forward of the bend in the frame.

This mobility device may further comprise a rocking bar support disposed between the left rear leg of the support frame and the right rear leg of the support frame, wherein the rocking bar is adapted to contact the rocking bar support. The rocking bar may be pivotally mounted to the support frame by way of a rocking bar hinge. Such a rocking bar hinge may comprise an inner hinge, an outer hinge, and a friction disk disposed between the inner hinge and outer hinge. Alternative arrangements may be employed wherein the rocking bar hinge is adapted to cushion the impact of the rocking bar as it makes contact against the rocking bar support.

This mobility device may also include a rocking bar lock mechanism to adjust the height and reach of the device for a user. The device may further include a left handle extending away from the left front leg, and a right handle extending away from the right front leg. A handle height lock mechanism may be disposed on each handle to adjust the height of each handle. This device may also comprise a leg lock mechanism to allow the device to be collapsed when not in use. The leg lock mechanism may be a pin and hole arrangement or the like.

Yet another exemplary embodiment of the disclosed subject matter is a device comprising a frame in communication with a brace and an arcuate base, wherein the frame is angled and supports a user's hands generally forward of the bend in the frame. The arcuate base permits a rocking motion. The device is adjustable in both height and reach to accommodate and optimize a user's abilities and proportions.

The frame of this device may be made from aluminum tubing, whereby the device may be lightweight and well-suited for travel. Portability is made even easier as the device is collapsible. Collapsibility may be achieved via hinges placed about the bottom of the device and preferably at one end of the arcuate base. Clips may be employed to maintain the device in an upright position, as well as a stowed position. A strap may also be used to keep the device in a stowed position. A frictional strip may further be used on the bottom of the brace to keep the device in place during rocking or the like. Should the user find that additional weight is desired during the rocking motion, this device may also have a post disposed about the bottom of the device wherein one of more weights may be placed on the post.

BRIEF DESCRIPTION OF THE DRAWINGS

Some non-limiting exemplary embodiments of the disclosed subject matter are illustrated in the following drawings. Identical or duplicate or equivalent or similar structures, elements, or parts that appear in one or more drawings are generally labeled with the same reference numeral, optionally with an additional letter or letters to distinguish between similar objects or variants of objects, and may not be repeatedly labeled and/or described. Dimensions of components and features shown in the figures are chosen for convenience or clarity of presentation. For convenience or clarity, some elements or structures are not shown or shown only partially and/or with different perspective or from different point of views.

DETAILED DESCRIPTION

When a person stands from a sitting position, there are typically two phases: (1) moving the body's center of gravity forward to a position over or in front of the feet; and (2) using leg muscles to straighten the hips and knees to achieve a standing position. These two movements usually occur smoothly and sequentially so under normal circumstances one is not aware of the two separate phases. But when a person is frail or otherwise infirm, such movements may be difficult. Indeed, a frail or infirm person may be incapable of standing from a seated position, such as from a chair, sofa, bed, or toilet, without assistance from another person.

When a helping hand is not around, devices are sometimes used to aid an individual in standing. Such devices include mechanically assisted armchairs that lift and tilt the person forward to a position from which it is easier to stand. These devices are typically bulky, expensive, and immobile. Other such devices include portable, standalone frames that provide a handhold for a person to grab onto but thereafter do not permit further mobility. Moreover, many such devices still require the assistance of another person to stabilize the device in use.

Accordingly, a mobility device solving these and other problems is desired.

Figure 1:
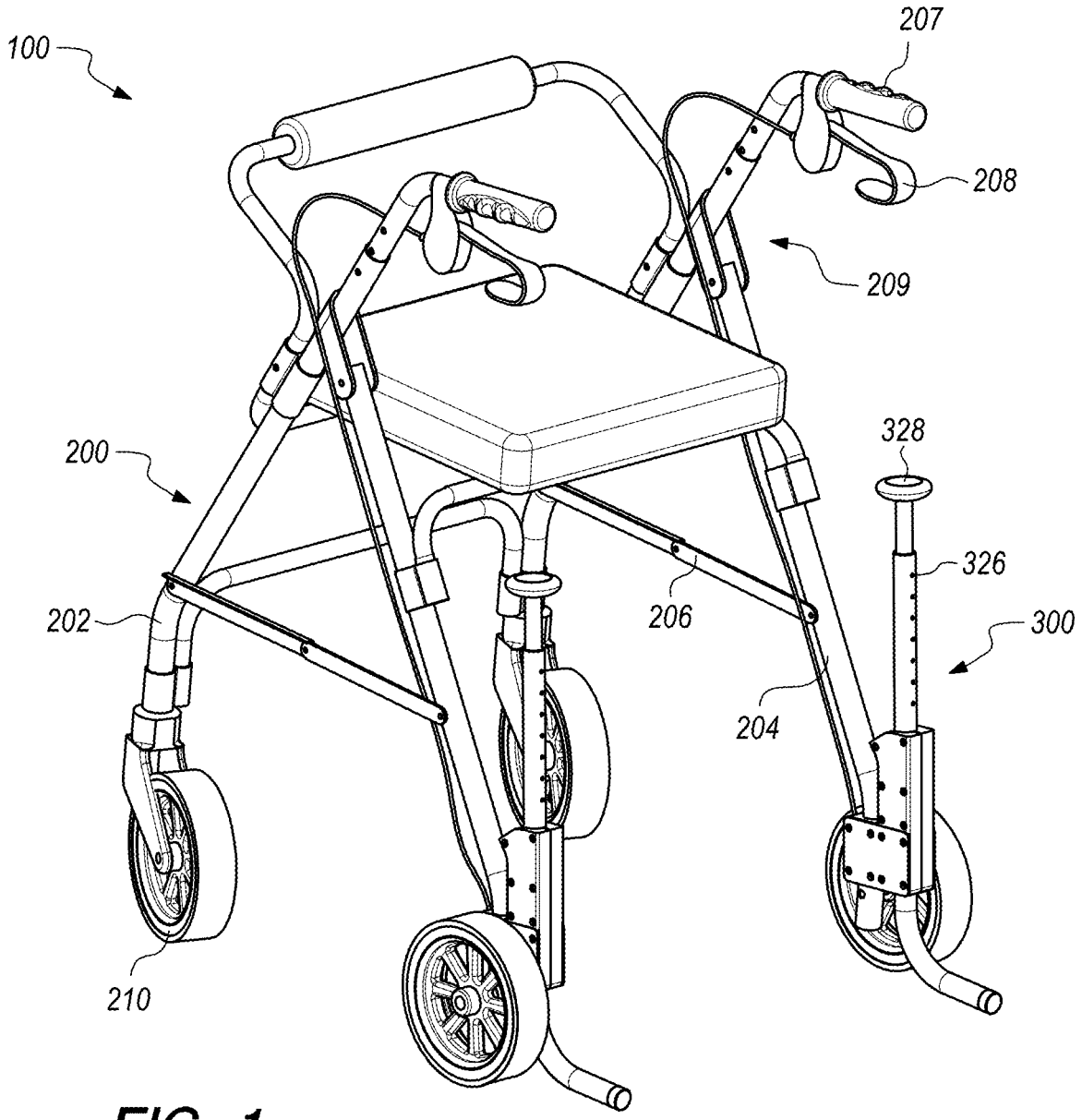
FIG. 1 is a perspective view of an embodiment of a mobility device disclosed herein, wherein both boosters are in the neutral position.

FIGS. 1-8D illustrate embodiments of a mobility device 100 for aiding an individual to stand, sit, rehabilitate, or generally move about. Mobility device 100 may comprise a frame 200 coupled to one or more boosters 300. Frame 200 includes left and right front supports 202 in communication with left and right rear supports 204. One or more cross braces 206 serve to stabilize device 100 when in use, as seen in FIG. 1 that shows device 100 in its open/non-folded position. Device 100 may also include one or more wheels 210 to permit the device 100 to be readily mobile. Device 100 may further include one or more brakes 208 in communication with the one or more wheels 210 for stopping the device 100 once in motion or keeping the device 100 stationary as desired.

The frame 200 may be comprised of aluminum tubing that may be rounded, oval, or similarly shaped. Indeed, all tubular supports in the device 100 may be comprised of one or more pieces of aluminum or the like to render device 100 light in weight and portable.

Figure 8D:
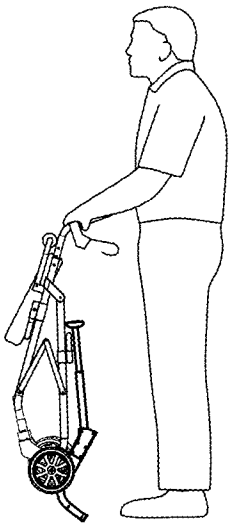
FIGS. 8A-8D show the mobility device of FIG. 1 in operation wherein the user is seen seated in a chair in FIG. 8A, progressing to a standing position in FIG. 8C without the aid of another individual or device, and standing next to the folded mobility device, which is now ready for easy storage or the like, in FIG. 8D.
Figure 8C:
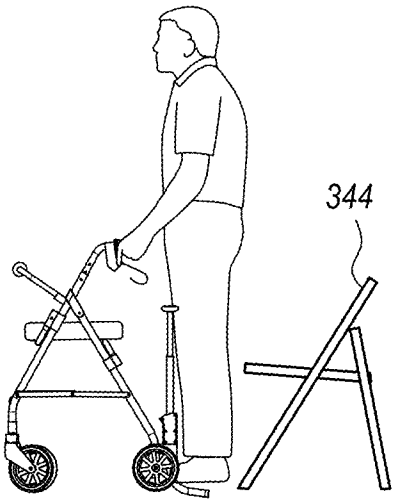

As seen in FIG. 1, handlebars 207 extend from the front supports 202 toward the rear of the device 100. The height of the handlebars 207 may be adjustable to fit different heights of the user of device 100, wherein the ideal height permits each user to hold onto the handlebars 207 comfortably when standing (as illustrated in FIG. 8C) or walking, and also brake as needed. However, the height of the handlebars 207 is not adjustable so as to be lower than the junction point 209 of the front and rear supports 202, 204. As a result, a frail or infirm user seated in a chair or the like may have difficulty reaching the handlebars without the assistance of another person. Indeed, a particularly frail or infirm user may need assistance standing up to attempt to reach the handlebars 207. FIG. 8A is exemplary in this regard as it shows a user seated in a chair 344 that is much lower in height in comparison to the height of the handlebars 207.

One solution to this problem involves the embodiment seen in FIGS. 1-8D, wherein the boosters 300 permit a user to stand and reach the handlebars 207 with complete independence. As depicted for example in FIG. 1, boosters 300 are discrete components mounted to the rear supports 204. In the alternative, boosters 300 may be integral to the device 100. Moreover, another embodiment of boosters 300 may be a completely standalone invention comprising telescoping vertical supports that may be removably mounted to a footpad. The height of the supports may be adjustable via a biased pin and hole arrangement or the like. As such an embodiment is easily portable, it may be used in conjunction with frame 200 or with any other device or situation where a user desires to ascend or descend without third party assistance.

Figure 2:
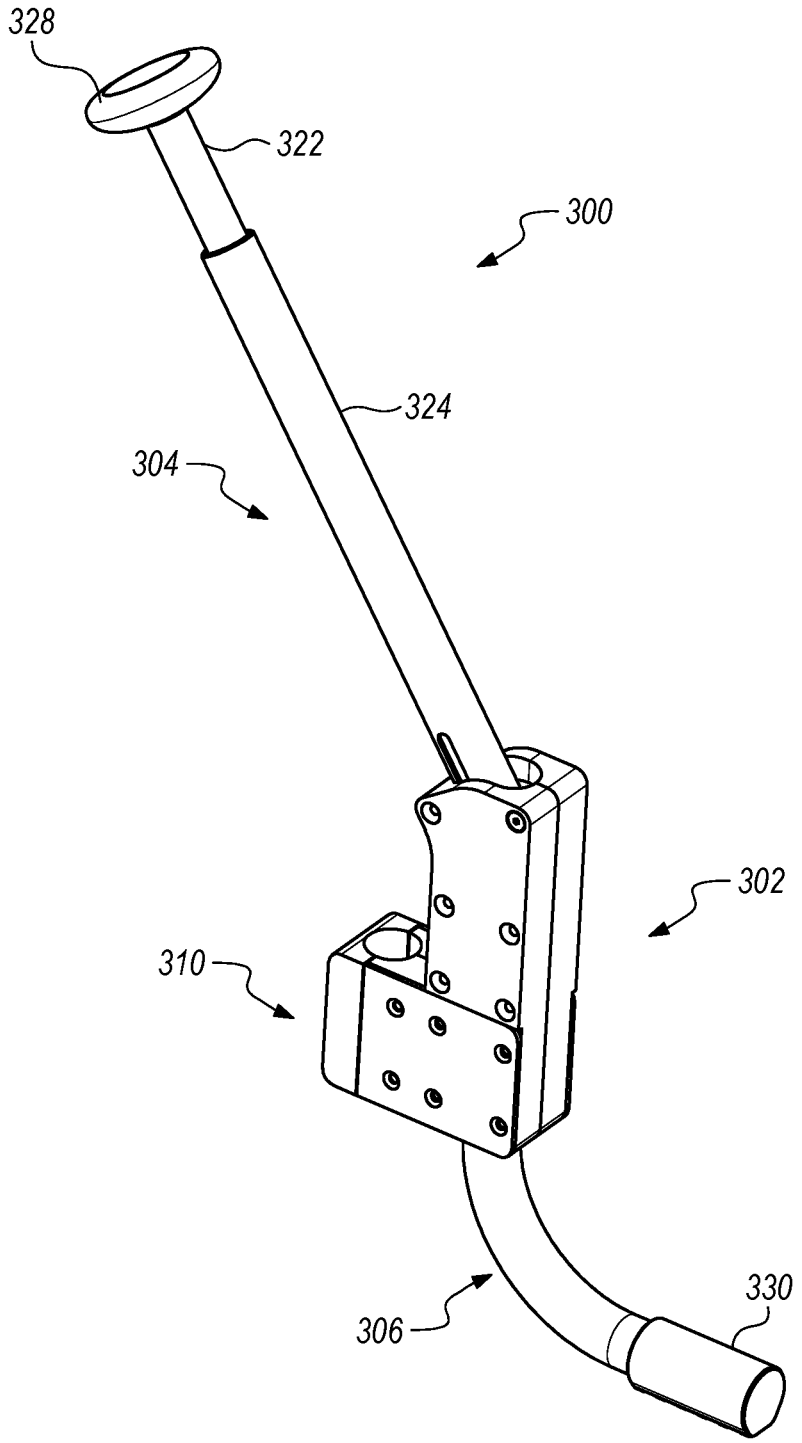
FIG. 2 is a perspective view of one of the boosters seen in FIG. 1, wherein the booster is in the folded position.

Focusing on FIGS. 1 and 2, booster 300 may include a housing 302 in communication with a top support 304 and a bottom support 306. Housing 302 preferably includes mounting means 310 for mounting the booster 300 to a rear support 204. As seen in FIG. 1, bottom support 306 may be curved. Bottom support 306 may also be vertical or other configuration as desired. Whether vertical or curved, bottom support 306 preferably includes an anti-slip material, such as a rubber pad 330 or the like to aid in stabilizing the device 100 when in non-locomotion use.

Booster 300 is preferably adjustable in height as desired to accommodate different user characteristics. To achieve adjustability, top support 304 preferably telescopes and does so via a two-piece, inner and outer tube configuration with a biased pin and hole arrangement or the like. FIGS. 1 and 2 illustrate holes 326 in outer tube 324 upon which inner tube 322 may slide. In use, the user would push down on the biased pin (not shown) extending from the inner tube 322 until the desired height is reached, wherein the user would release the pin and it would pop into the respective hole 326 of the outer tube 324. For further ease and comfort of use, the booster 300 may include a handgrip 328. The handgrip may also advantageously be marked with a brand name for prominent marketing purposes.

Booster 300 is also capable of multiple positions for different purposes including mobility of the device 100 when in use and ease of portability of the device 100 for transport or storage. To achieve such multiple positions, booster 300 preferably includes certain components and structural arrangement best seen in FIGS. 3-6.

Figure 3:
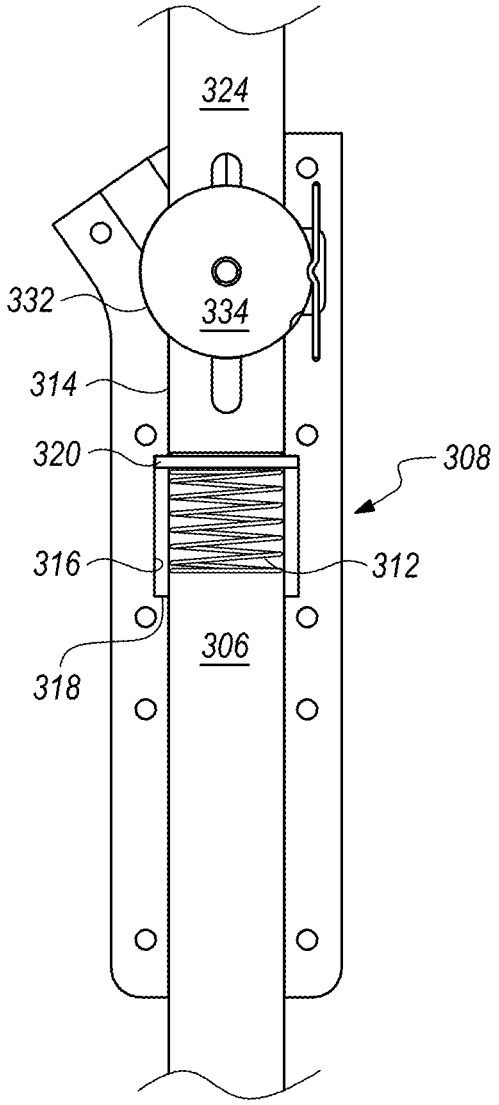
FIG. 3 is a partial cut-away and detailed side view of certain aspects of one of the boosters seen in FIG. 1, wherein the booster is in the neutral position.
Figure 4:
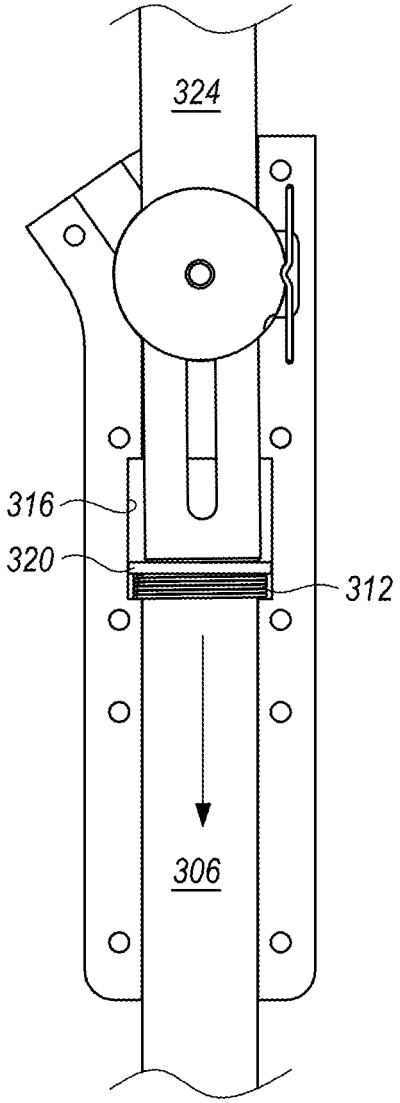
FIG. 4 is a partial cut-away and detailed side view of certain aspects of one of the boosters seen in FIG. 1, wherein the booster is in the compressed position.
Figure 5:
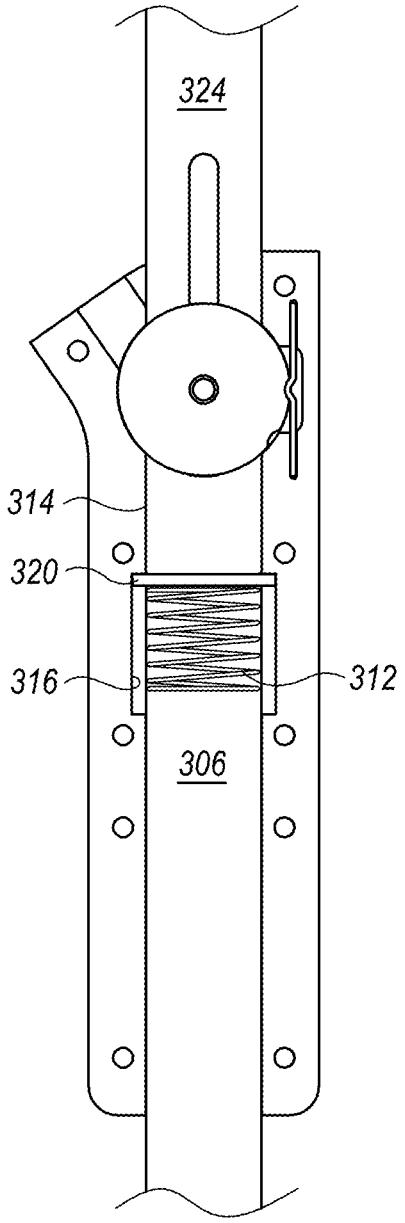
FIG. 5 is a partial cut-away and detailed side view of certain aspects of one of the boosters seen in FIG. 1, wherein the booster is in the extended upward pre-folded position.
Figure 6:
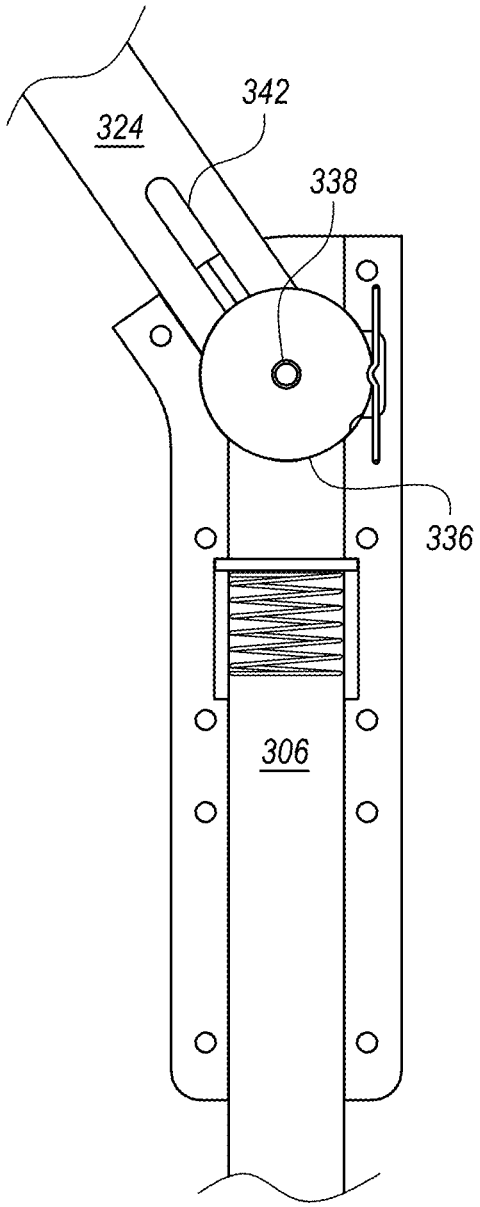
FIG. 6 is a partial cut-away and detailed side view of certain aspects of one of the boosters seen in FIG. 1, wherein the booster is in the folded position.
Figure 7:
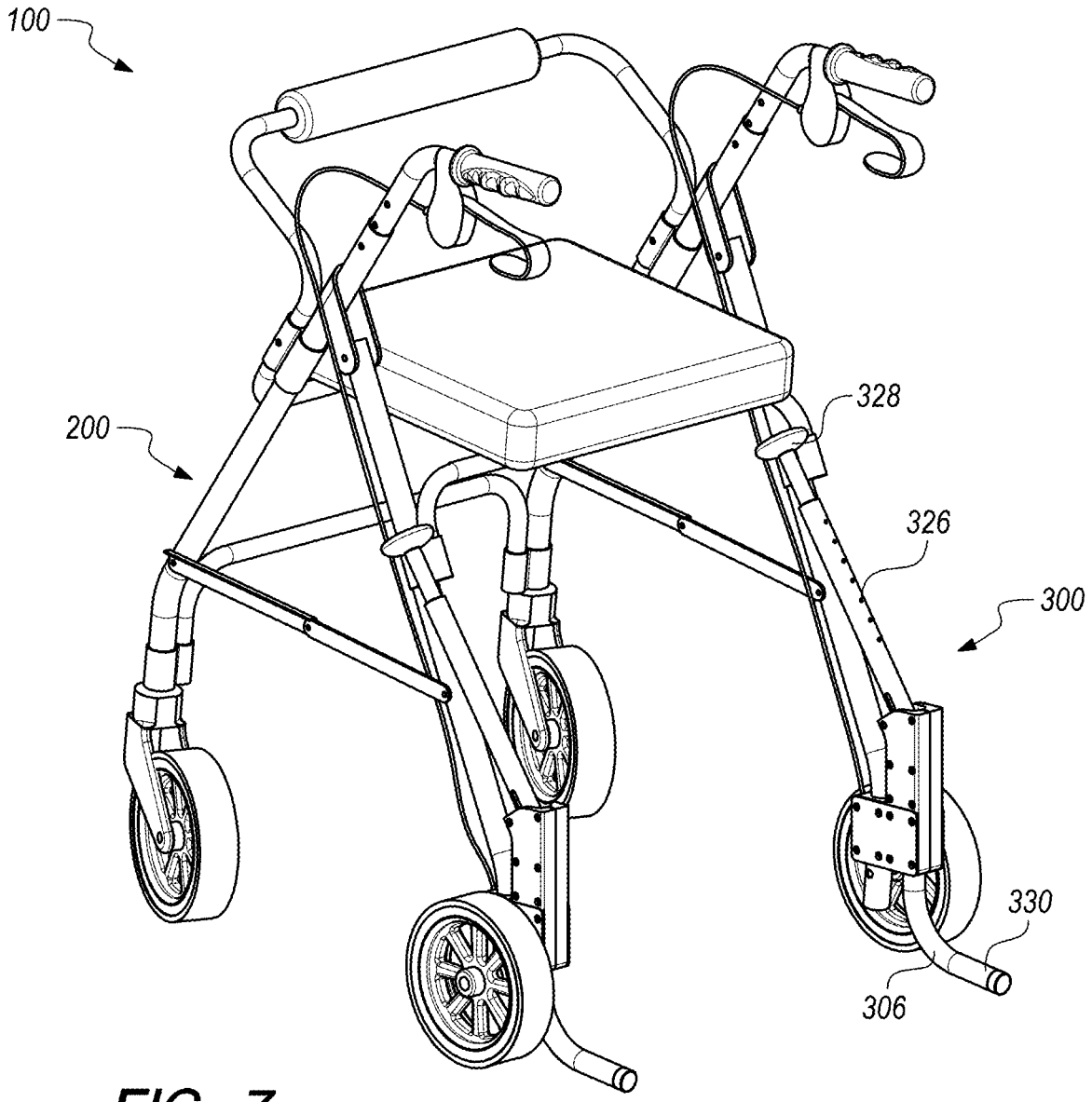
FIG. 7 is a perspective view of the mobility device seen in FIG. 1, wherein both boosters are in the folded position.

These figures particularly illustrate the internal workings of the booster 300 in different positions or stages of operation. To elaborate, FIG. 3 shows the booster 300 in the neutral position. FIG. 4 shows the booster 300 when it is in the compressed position. FIG. 5 illustrates the booster 300 in the extended upward pre-folded position, whereas FIG. 6 shows the booster 300 in its folded position.

Focusing now on the details of FIGS. 2-6, booster 300 preferably comprises housing 302 for holding a sleeve 308. Sleeve 308 includes a top channel 314 in communication with a bottom channel 316 having a floor 318. Top channel 314 is configured to receive outer tube 324. Bottom channel 316 is configured to receive bottom support 306. Bottom channel 316 is also configured to receive a spring 312 or the like and a retaining ring 320. Spring 312 is preferably disposed between the floor 318 and the retaining ring 320. This structure permits the booster 300 and particularly the bottom support 306 to be raised off the ground when the user is mobile with device 100 as disclosed in more detail below.

To permit the booster 300 to be folded and in a configuration compatible with the symmetry of the frame 200, sleeve 308 may further comprise a socket 332 configured to receive a roller 334. Roller 334 may include a bottom hole 336 and a central hole 338. Bottom hole 336 is configured to receive the outer tube 324. A roller pin (not shown) is inserted through hole 336 to couple the roller 334 to the outer tube 324. To do so, outer tube 324 preferably includes a roller slot 342 configured to receive the roller pin. The roller slot 342 and pin work together to limit both the upper and lower limits of travel of the top support 304.

Turning to FIG. 3, the neutral position is the basic rest position of the booster 300. Such a position may also be seen in FIGS. 1 and 8A. In this position, the spring 312 is relaxed, with the outer tube 324 resting atop the retaining ring 320.

Figure 8B:
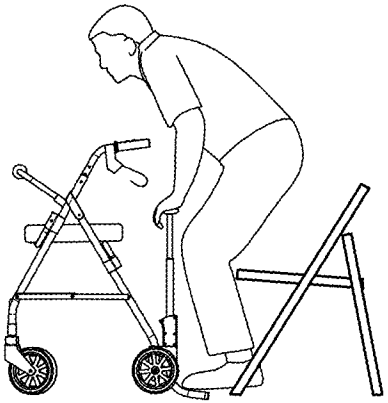
Figure 8A:
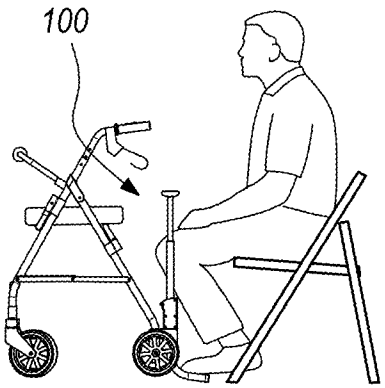

As seen in FIGS. 4 and 8B, the compressed position shows outer tube 324 pushing downward against the retaining ring 320 that in turn compresses spring 312 that in turn forces bottom support 306 downward to contact the ground. The total travel of the bottom support 306 is preferably ⅝". Releasing the downward force on the top support 304 returns to the booster 300 to its neutral position wherein the bottom support is again raised above the ground.

Turning in detail to FIG. 5, the extended upward pre-folded position illustrates the top support 304 pulled upward until the lower end of the roller slot 342 contacts the center pin associated with roller 334. In this position the lower end of outer tube 324 has been pulled into the body of the roller 334 allowing it and the top support 304 to be able to rotate forward.

With reference to FIGS. 2, 6, 7, and 8D, the folded position involves outer tube 324 and roller 334 rotated forward and held in position as the housing 302 prevents outer tube 324 from returning to its original position until it has been rotated back to vertical and drops into the top channel 314 between the roller 334 and the upper end of outer tube 324, resulting in the neutral position.

It should now be apparent the disclosed device 100 and particularly booster 300 is portable and inexpensive compared to conventional devices. Moreover, as device 100 may be used by a person in their own home, the result is one that provides independence of living for longer than otherwise may have been possible.

As the device 100 is collapsible, it may therefore be taken to other locations for visiting, such as a grandchild's home. In a similar manner, the device 100 may also be used in hospitals, nursing homes, assisted living homes, rehabilitation centers, or the like where staff may use the time previously taken to assist people to rise from their chair in more profitable ways. Furthermore, the device 100 may reduce the amount of back injury frequently sustained by support staff when helping people to stand from a chair.

The device 100 may furthermore be used in the rehabilitation of persons who have diminished capability to stand from a seated position due to muscle atrophy, injury, or other conditions in which mobility could be improved with physical therapy using this invention.

In addition, as discussed above, booster 300 also advantageously may be sold as a retrofit kit wherein a user may already have a conventional walker or the like and desires to increase functionality of such a walker by incorporating aspects of the invention.

FIGS. 9-15E illustrate other embodiments of a mobility device 400 for aiding an individual to stand, sit, rehabilitate, or otherwise be mobile. Mobility device 400 may comprise a support frame 402 and a rocking bar 404 pivotally coupled to the support frame 402. The frame 402 and rocking bar 404 may each be comprised of one or more tubular supports, such as aluminum tubing, that may be rounded, oval, or similarly shaped. Indeed, all tubular supports in the device 400 may be comprised of one or more pieces of aluminum to render device 400 light in weight and portable.

Support frame 402 is generally triangular and preferably comprises a left front leg 410, an opposing right front leg 412, a left rear leg 406, and an opposing right rear leg 408. Front legs 410, 412 are coupled to rear legs 406, 408, such as via respective leg lock mechanisms 438 or the like, as disclosed below in more detail. A bottom brace 414 connects left leg 410 to right leg 412. A top brace 416 is disposed horizontally above bottom brace 414, and also connects left leg 410 to right leg 412. An anti-skid material, such as rubber pads 458, may be placed on the bottom end of the legs 406, 408 to keep the device 400 in place during operation.

A rocking bar support 428 is disposed horizontally above top brace 416, and also connects left leg 410 to right leg 412. Left handle 430 extends from left front leg 410. Similarly, right handle 432 extends from right front leg 432. Each handle 430, 432 is bent at an angle substantially transverse to front legs 410, 412, wherein the longitudinal axis of each handle 430, 432 is substantially parallel to the ground on which the device 400 may sit.

Rocking bar 404 is generally U-shaped and preferably comprises a left rear leg 418, an opposing right rear leg 420, a left angled support 422 extending from the left rear leg 418, a right angled support 424 extending from the right rear leg 420, and a connecting member 426 disposed between left angled support 422 and right angled support 424. Padding 460 may cover connecting member 426 to permit more comfort for the user during operation of the device 400. In a similar manner, a left arm support 434 is disposed about left angled support 422, and a right arm support 436 is disposed about right angled support 424. Each arm support 434, 436 may be of an arcuate form that anatomically supports the user's forearms.

Figure 12A:
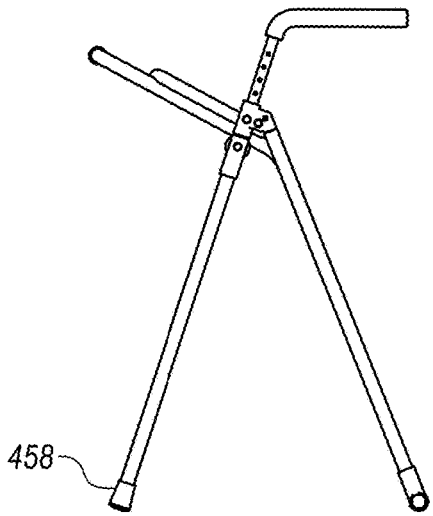
FIG. 12A is a side view of the device seen in FIG. 9 wherein the rocking bar is fully seated against the rocking bar support, and wherein the handle has been extended away from the front legs.
Figure 12B:
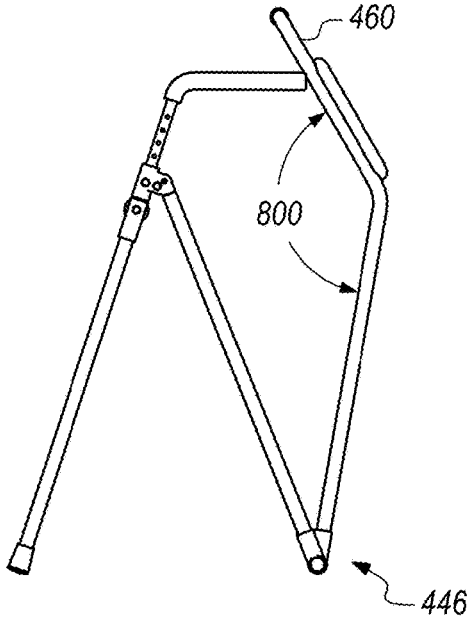
FIG. 12B is a side view of the device of FIG. 9 wherein the rocking bar is no longer seated against the rocking bar support, and wherein the handle has been extended away from the front legs.

The left angled support 422 and right angled support 424 of rocking bar 404 are bent at an angle 800 to their respective legs 418 and 420, as seen for example in FIG. 12A. The angle 800 is preferably obtuse to permit a user to have their center of gravity substantially over their feet when the device 400 is in operation, as seen for example in FIGS. 15A-15E.

Figure 10:
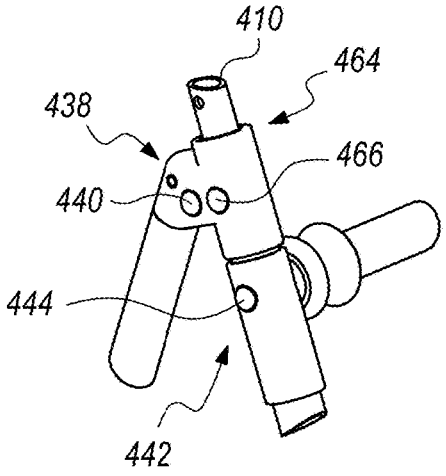
FIG. 10 is a perspective, detailed view of the leg lock mechanism and handle height lock mechanism of the device seen in FIG. 9.
Figure 13A:
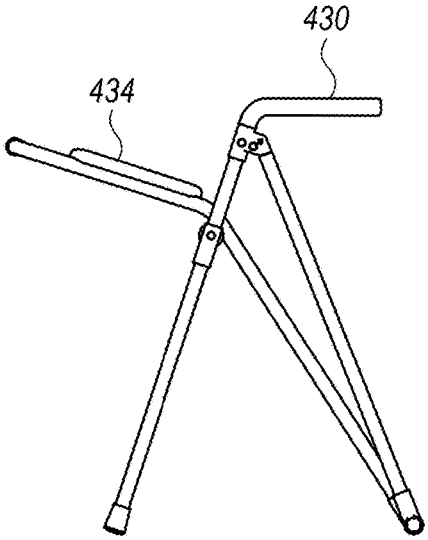
FIG. 13A is a side view of the device seen in FIG. 9 wherein the rocking bar is fully seated against the rocking bar support, and wherein the handle has been lowered toward the front legs compared to that seen in FIG. 9.
Figure 13B:
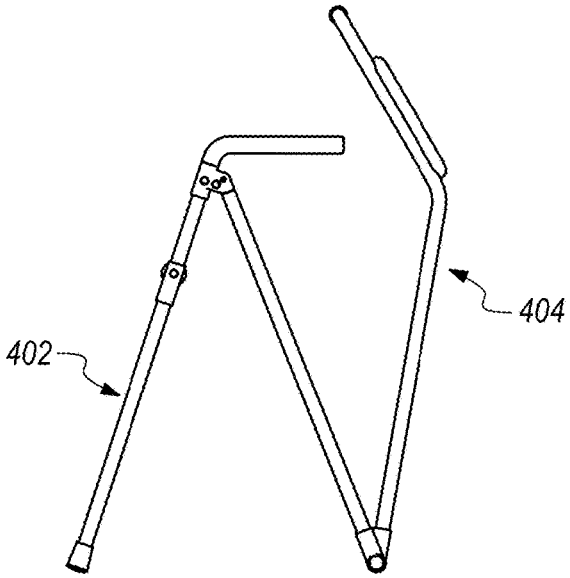
FIG. 13B is a side view of the device of FIG. 9 wherein the rocking bar is no longer seated against the rocking bar support, and wherein the handle has been lowered toward the front legs compared to that seen in FIG. 9.

Mobility device 400 is adjustable in myriad ways to accommodate a range of users. In particular, device 400 is preferably adjustable in both height and reach to optimize a user's abilities and proportions. For example, handles 430, 432 may be extended away from their respective legs 410, 412 and maintained at a desired height via a handle height lock mechanism 464, as best seen in FIG. 10. Such a mechanism 464 may comprise a spring-biased pin and hole, or similar arrangement known to those of ordinary skill in the art, as represented by pin 466 with preferably 6" of travel permitted by way of the holes configured to receive the pin 466. By compressing the pin 466, the respective handle 430, 432 is rendered free to slide within the respective leg 410, 412 until the pin 466 finds alignment within a respective hole. By way of further illustration, FIG. 12A illustrates how handles 430, 432 may be extended away from legs 410, 412, whereas FIG. 13A illustrates how handles 430, 432 are not extended for a user of smaller stature or reach.

Rocking bar support 428 is also adjustable. Referring again to FIG. 10, a rocking bar lock mechanism 442 may comprise a spring-biased pin and hole or similar arrangement, as represented by pin 444 with preferably 5" of travel permitted by way of the holes configured to receive the pin 444. Adjusting this travel alters both height and reach of the rocking bar 404 for the user.

Figure 11:
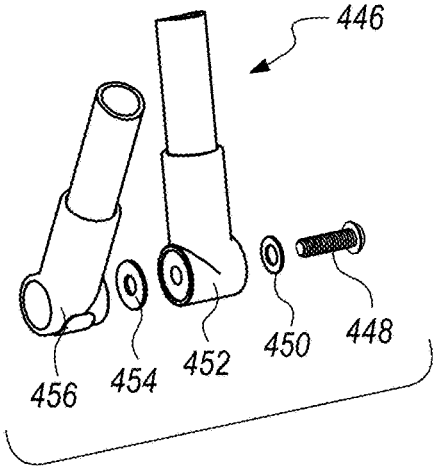
FIG. 11 is a perspective, detailed view of the rocking bar lock mechanism of the device seen in FIG. 9.

Rocking bar 404 is preferably pivotally coupled to the support frame 402 by way of a rocking bar hinge 446 disposed about the bottom of the legs 406, 408 of the frame 402 and legs 418, 420 of the rocking bar 404. The rocking bar hinge 446 provides adjustable friction to keep the rocking bar 404 in any position hands-off. The rocking bar hinge 446 may comprise an inner hinge 452 and outer hinge 456 with a friction disk 454 disposed therebetween. The disk 454 provides adjustable degrees of friction as the inner and outer hinges 452, 456 are drawn together by means of a bolt 448 and washer 450, as seen in FIG. 11. In the alternative to this type of arrangement, the rocking bar hinge 446 may comprise a looped spring and torsion bar or torsion rods that engage as the rocking bar 404 moves forward of top dead center, providing increasing resistance as the user leans forward. Similar known arrangements, whether mechanical or pneumatic, may also be employed to lessen the impact as the rocking bar 404 contacts the rocking bar support 428 during operation. In other words, as the user leans forward pressing the rocking bar 404 forward as seen in FIGS. 15A-15E, the rocking bar hinge 446 slows the user's momentum for a safer landing, as well as boosting the user's sense of security.

Once adjusted, the device 400 permits the user to stand up from a seated position or vice versa using leg muscles, rather than arm muscles that are typically far weaker than leg muscles. For example, when using the device 400 to stand, the configuration of the device 400 permits the user to have their hands grip near the top of the device 400 and rock it forward until the user finds their body over their feet, resulting in the perfect position to stand up without assistance. FIGS. 15A-15E illustrate such ease of operation of the mobility device 400.

Figure 9:
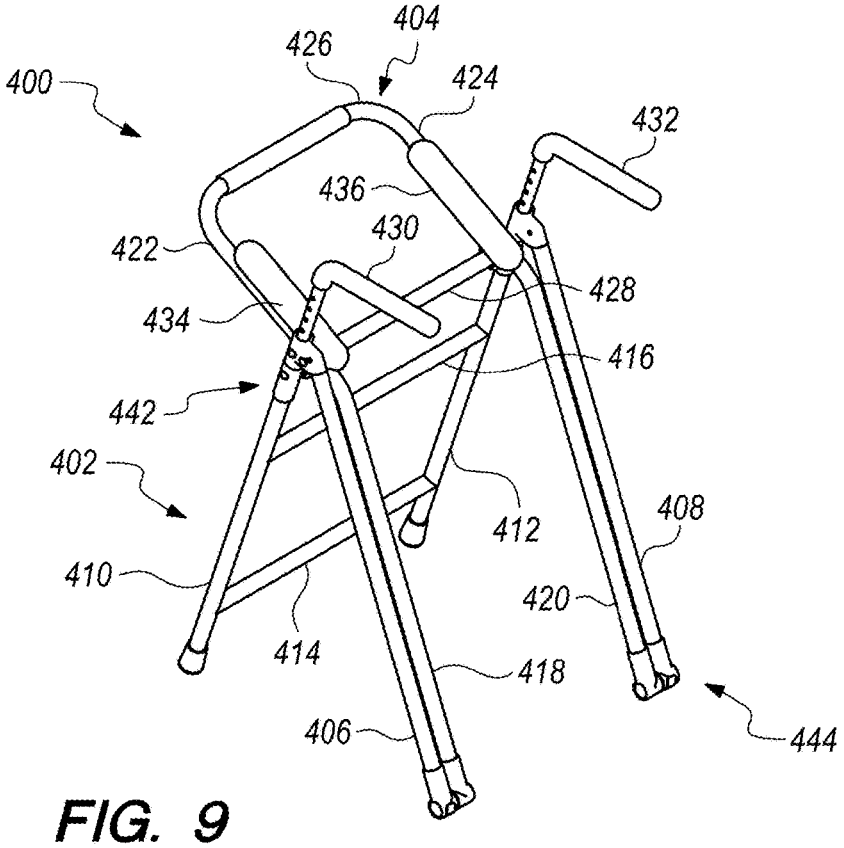
FIG. 9 is a perspective view of another embodiment of a mobility device disclosed herein.
Figure 14:
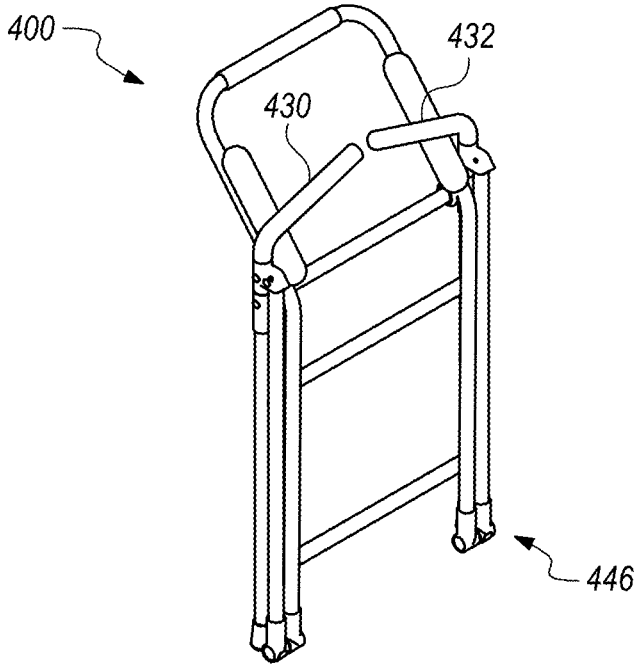
FIG. 14 is a perspective view of the device of FIG. 9, wherein that device has been collapsed for ease of portability.
Figure 15A:
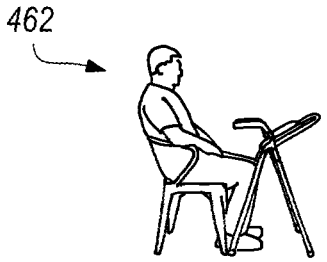
FIGS. 15A-15E show the device of FIG. 9 in operation wherein the user is seen seated in a chair in FIG. 15A and progressing to a standing position in FIG. 15E without the aid of another individual or device.
Figure 15B:
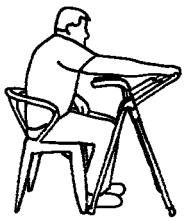
Figure 15C:
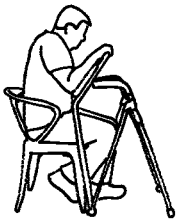
Figure 15D:
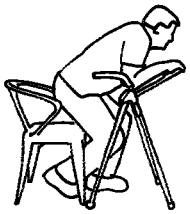
Figure 15E:
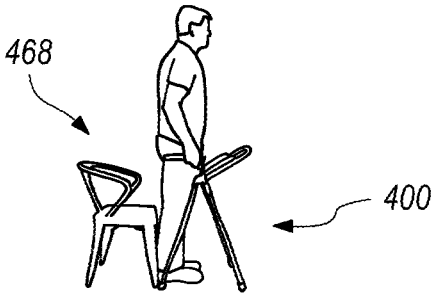

Collapsibility of the device 400 may be achieved via a leg lock mechanism 438, such as that seen in FIG. 10, wherein leg lock mechanism 438 is preferably disposed on each of the legs 410, 412. The mechanism 438 may comprise a spring-biased pin and hole or similar arrangement, as represented by pin 440, that is released to lock the respective leg 410, 412 as seen in FIG. 9. When not locked, the device 400 may be folded, as seen in FIG. 14. Moreover, the device may have wheels and brakes added for when the device is in operation.

It should now be apparent the disclosed device 400 is lightweight, portable, and inexpensive compared to conventional devices. As such, it may be used in many different places and circumstances: rising from a chair, sofa, toilet, bed, or the like. The device 400 may also be used in reverse, enabling the user to descend in a controlled manner into a seated position.

The device 400 advantageously permits the user to shift their center of gravity forward, using the user's own momentum and that of the device 400, to the optimum position from which to stand. The momentum is initiated by a rocking motion facilitated by the angled rocking bar 404. The rocking bar support 428 stops the rocking, permitting the user to stand erect.

Once the user is in the correct forward position, it is then much easier to achieve the vertical standing position with leg muscles with little or no assistance from arm muscles. The device 400 also provides stability for the user when in the standing position. The device 400 may thus be used by a person in their own home, providing independence of living for longer than otherwise may have been possible.

As the device 400 is collapsible, it may therefore be taken to other locations for visiting, such as a grandchild's home. In a similar manner, the device 400 may also be used in hospitals, nursing homes, assisted living homes, rehabilitation centers, or the like where staff may use the time previously taken to assist people to rise from their chair in more profitable ways. Furthermore, the device 400 may reduce the amount of back injury frequently sustained by support staff when helping people to stand from a chair.

The device 400 may furthermore be used in the rehabilitation of persons who have diminished capability to stand from a seated position due to muscle atrophy, injury, or other conditions in which mobility could be improved with physical therapy using this invention.

In addition, the device 400 also advantageously may be sold as a retrofit kit wherein a user may already have a conventional walker and desires to increase functionality of such a walker by incorporating aspects of the invention. Such a retrofit kit may comprise the rocking bar 428, legs 406, 408, rocking bar support 428, and/or rocking bar hinge 446. The conventional walker may then be modified to include these retrofit components. For example, should the conventional walker have padding over its handles, a user may slide any such padding off the handles, and then slide the rocking bar support 428 and legs 406, 408 over the handles. The padding may be put back as desired. Once this part of the assembly is complete, the user then attaches the rocking bar hinge 446 to the bottom portion of the legs 406, 408 to pivotally mount the rocking bar 404 to the support frame 402.

FIGS. 16-22E illustrate yet other embodiments of a mobility device 500 for aiding an individual to stand, sit, rehabilitate, or otherwise be mobile. The device 500 may comprise a frame 502 in communication with an arcuate base 504 and a brace 506.

The frame 502 is preferably an inverted U-shape from top 508 to bottom 510. The frame 502 itself may be comprised of one or more tubular supports, such as aluminum tubing, that may be rounded, oval, or similarly shaped. Indeed, all tubular supports in the device 500 may be comprised of one or more pieces of aluminum to render the device 500 light in weight and easily portable.

The frame 502 is angled and preferably has forearm supports 540 mounted on a cross bar 542 for a user's hands to rest generally forward of the bend or angle 900 in the frame 502. Each forearm support 540 may be of an arcuate form that anatomically supports the user's forearms. The angle 900 should be one that places the user, in their final position at the end of the forward rocking motion, with their center of gravity substantially over their feet. The preferred angle 900 is 70°-80° to ensure the user's center of gravity is fully contained within the base 504 throughout the entire standing or sitting process. Should the angle 900 be more than 90°, the device 500 will not function as designed because the user's center of gravity will be too far forward and the user will topple over the front. Should the angle 900 be less than 45°, the device 500 will similarly not function as designed because the user's center of gravity will be too far back.

Figure 16:
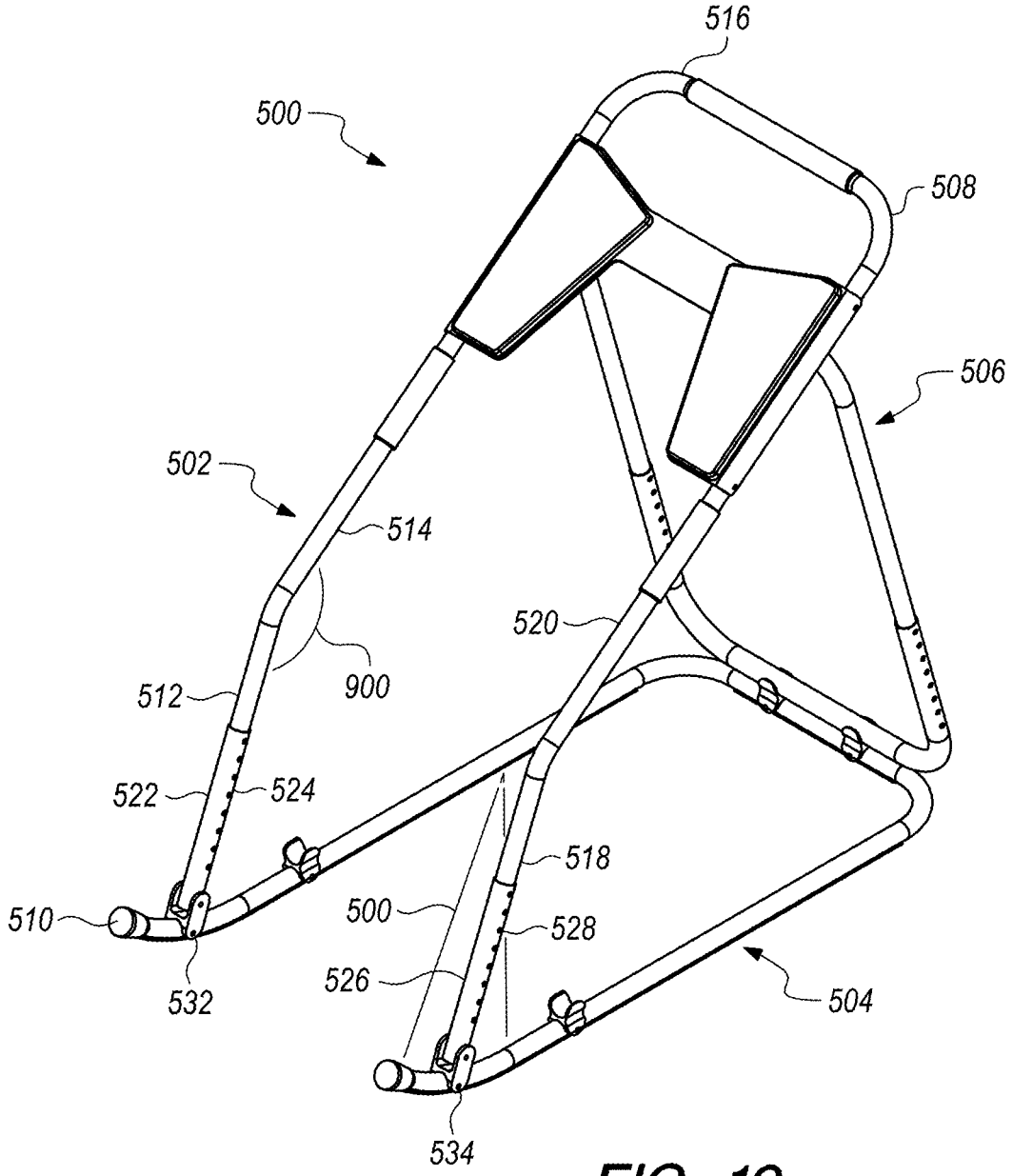
FIG. 16 is a perspective view of another embodiment of a mobility device disclosed herein.

As seen in FIG. 16, a first vertical support 512 rises upward from the bottom 510 and is bent at angle 900 at first angled support 514. A cross brace 516 communicates with second angled support 520, which in turn is bent and in communication with second vertical support 518. Grips, such as rubber padding, may be disposed about the frame 502 and particularly about the first angled support 514, cross brace 516, and second angled support 520, as seen in FIG. 16.

A first sleeve 522 is coupled to base 504 via a first hinge 532 at the bottom 510 of frame 502. The first sleeve 522 is configured to receive the first vertical support 512. In the same manner, a second sleeve 526 is coupled to base 504 via a second hinge 534 at the bottom 510 of the frame 502. The second sleeve 526 is configured to receive the second vertical support 518.

Like the frame 502, base 504 may be generally U-shaped and comprised of one or more tubular supports. Base 504 has an arcuate section at one end and a flat section at the opposing end. As seen in FIG. 16, each arcuate section has a consistent curved aspect wherein the preferred radius 900 is about 12".

Figure 17:
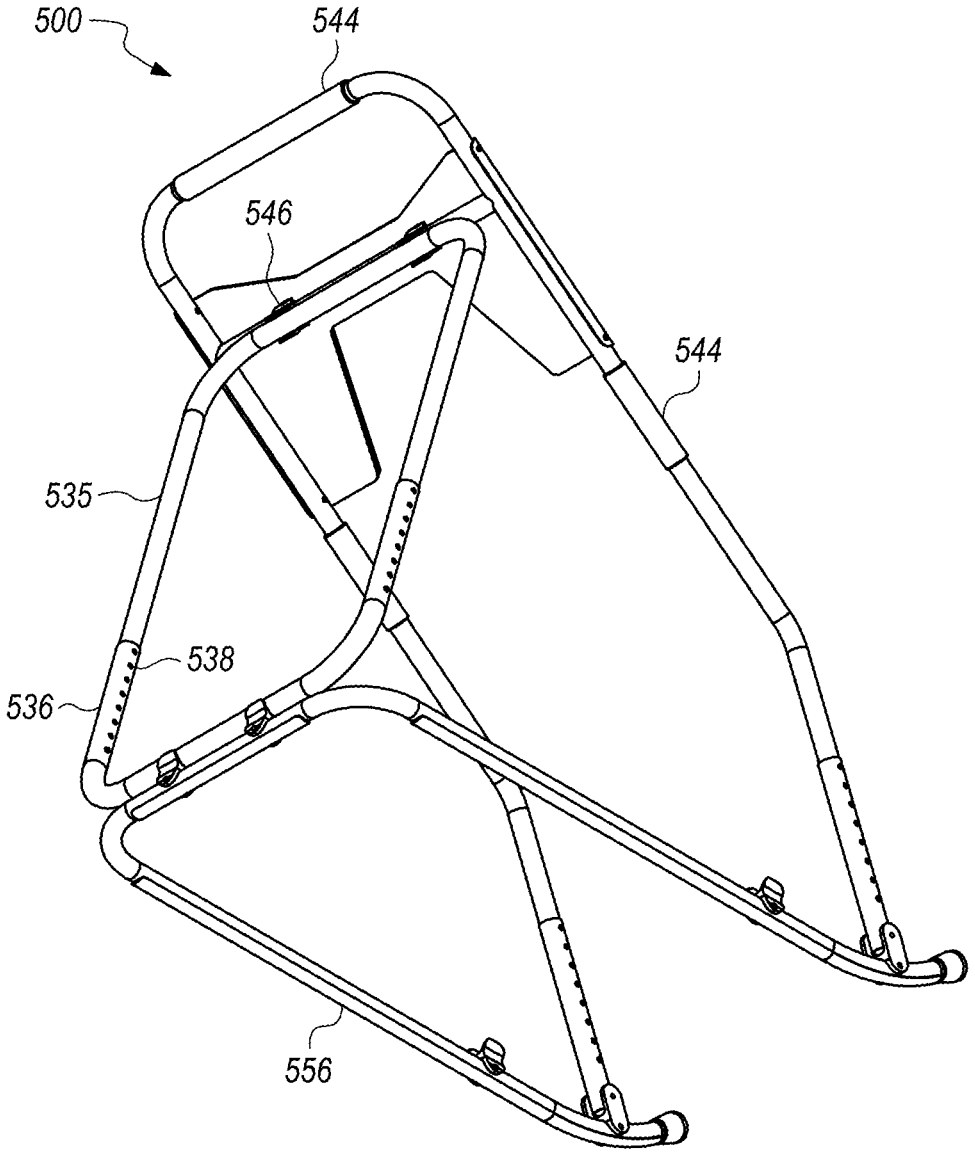
FIG. 17 is another perspective view of the device seen in FIG. 16.

Like the frame 502 and base 504, the brace 506 is comprised of one or more tubular elements and, as best seen in FIG. 17, preferably comprises a generally U-shaped member 535 and a generally U-shaped sleeve 536 configured to receive brace member 535.

Figure 18:
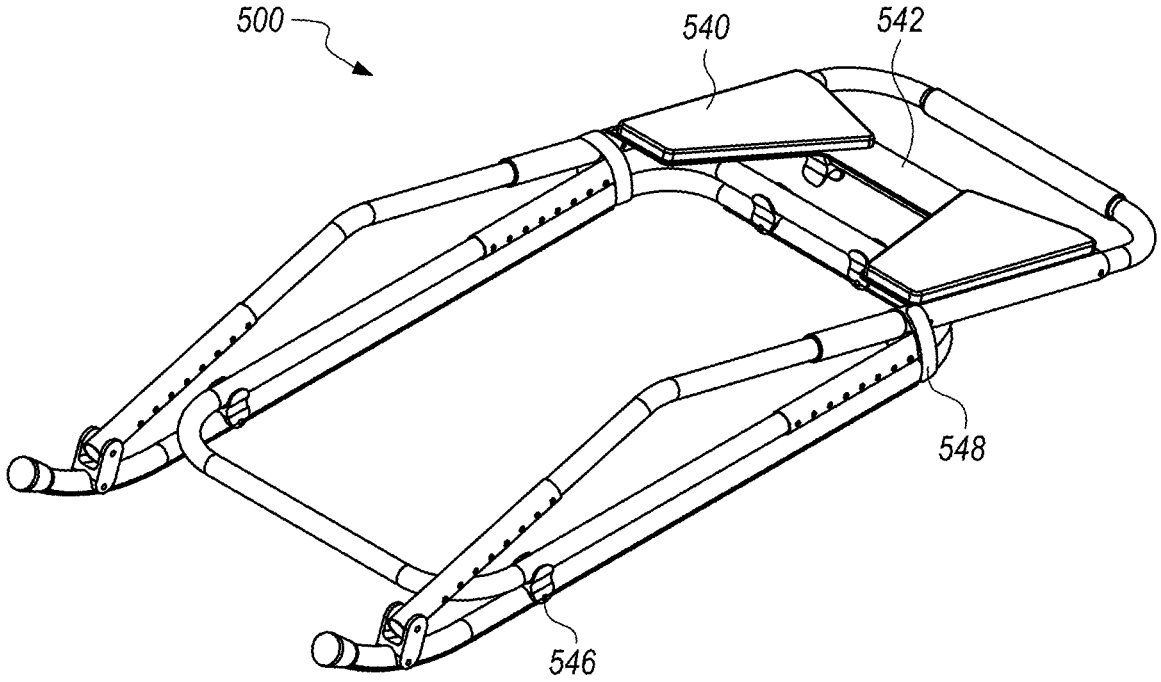
FIG. 18 is another perspective view of the device seen in FIG. 16, wherein the device is folded to allow it to be compact and easily transportable.
Figure 21A:
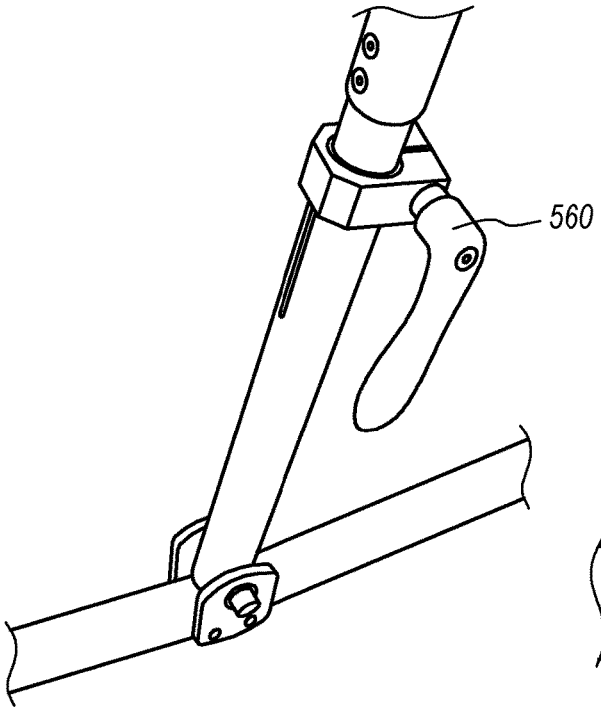
FIG. 21A illustrates an adjustment clamp and lever that may be employed with the device seen in FIG. 16.
Figure 21B:
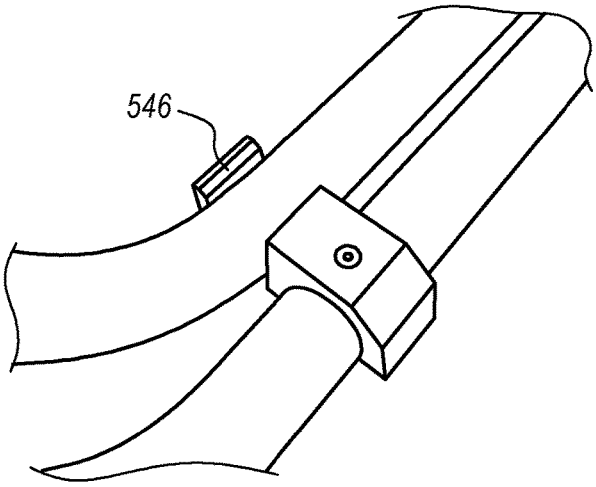
FIG. 21B illustrates a clip that may be used once the device seen in FIG. 16 has been folded for ease of transport.
Figure 22A:
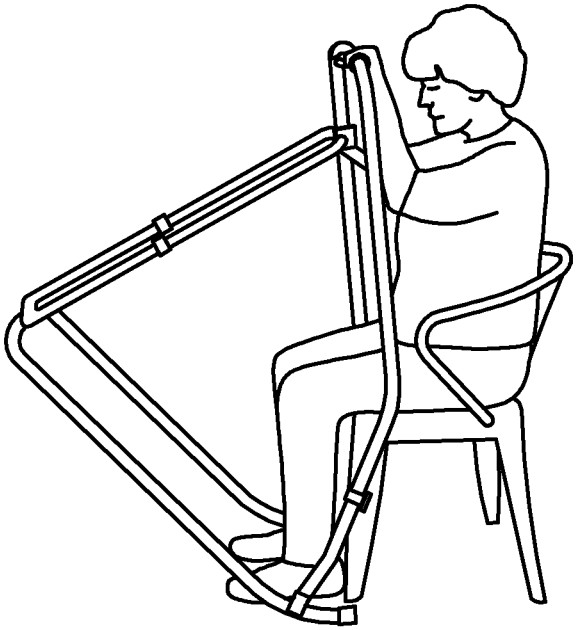
FIGS. 22A-22E illustrate use of the device seen in FIG. 16.
Figure 22B:
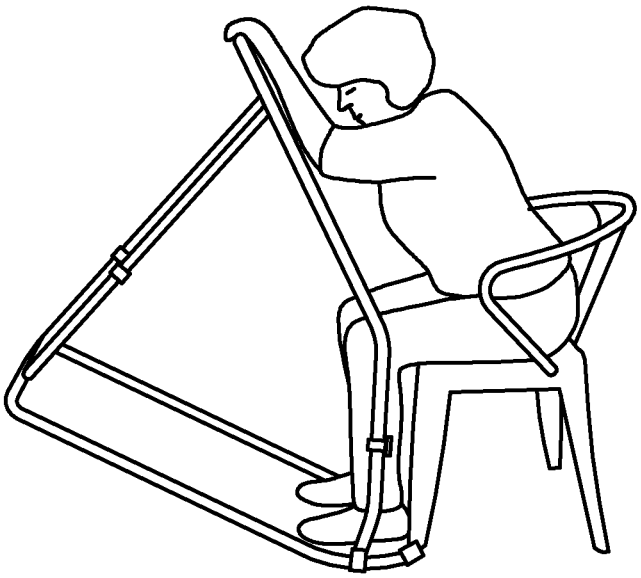
Figure 22C:
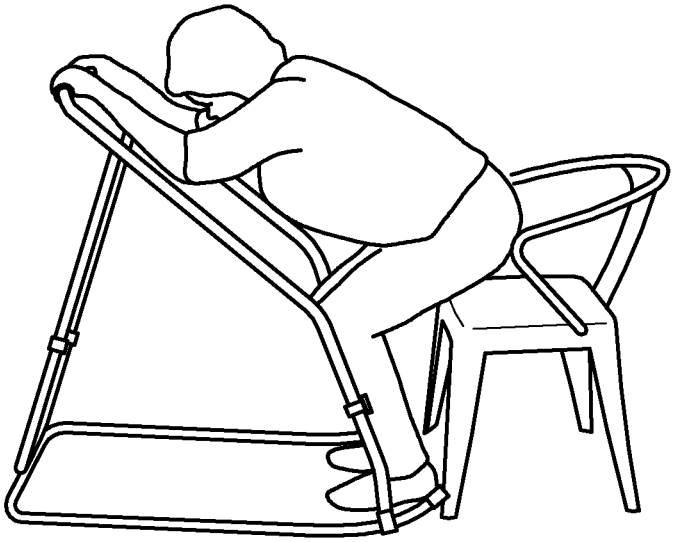
Figure 22D:
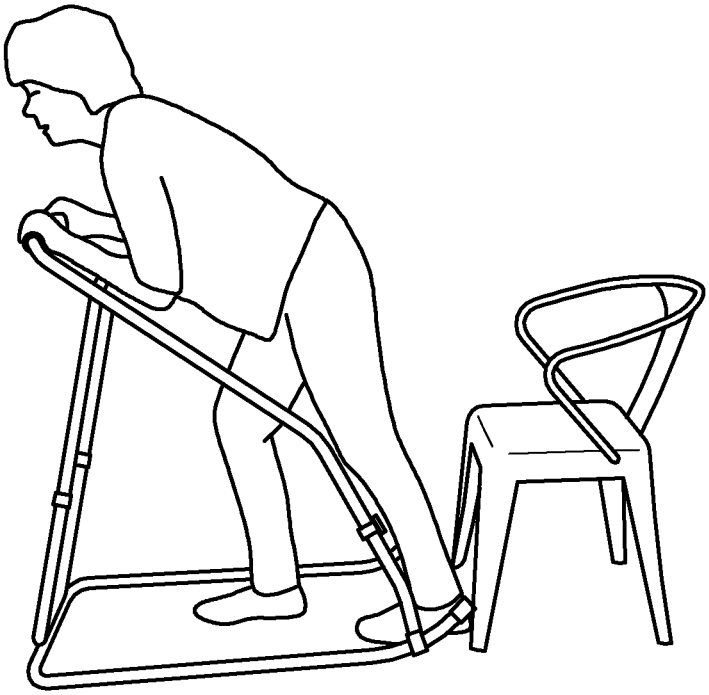
Figure 22E:
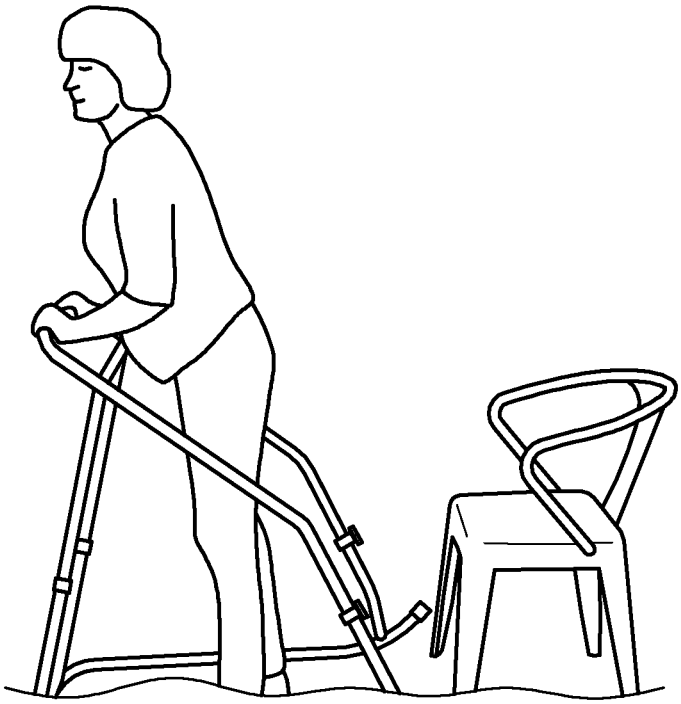

The device 500 is preferably adjustable in both height and reach to accommodate and optimize a user's abilities and proportions. FIGS. 16-18 best illustrate one embodiment of adjustability using a pin-and-hole arrangement, whereas FIG. 21A illustrates another means of adjustability. Any of these embodiments or means may be used alone or in combination.

Turning first to FIG. 16, sleeves 522 and 526 may have holes 524, 528, respectively cut therein. Corresponding spring-biased buttons or pins are disposed about vertical supports 512 and 518, wherein the holes 524, 528 are configured to receive the biased pins, respectively. By compressing the pins, vertical supports 512 and 518 are rendered free to slide with respect to their corresponding sleeves 522, 526, until the pins find alignment with holes 524, 528 and are respectively received therein. Thus, vertical supports 512 and 518 may be adjusted by increments set by respective hole spacing to help accommodate differently sized users. A similar pin-and-hole arrangement may be used to adjust the brace 506 wherein brace member 535 may be telescopically adjustable within brace member 536 via pins and holes 538 to raise or lower the device 500 and thus create a plurality of configurations to accommodate users of different size and ability.

Turning now to FIG. 21A, each vertical support 512, 518 may be adjustable via a clamp with threaded rod that is hand-tightened by a lever 560, effectively compressing the clamp and locking each telescoping tubes 512, 518 in relative position. Additionally, the lever 560 may be lifted and disengaged from its tightening nut to rotate the lever 560 to a position aligned with the tube 512, 518 in a non-protruding manner.

Figure 19A:
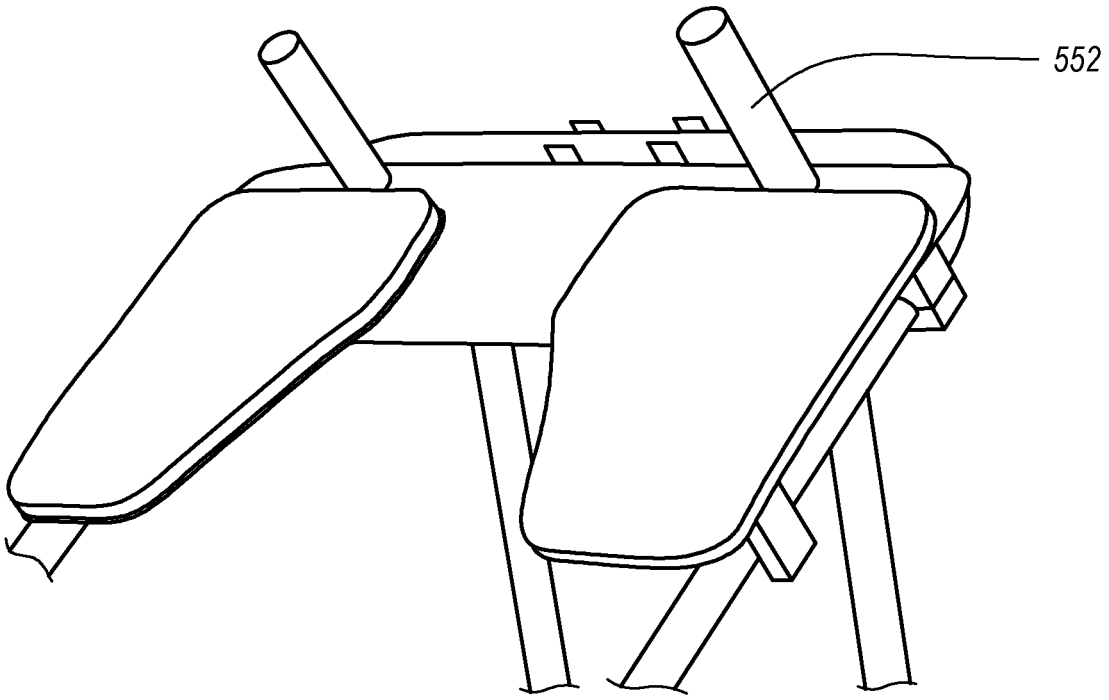
FIGS. 19A and 19B illustrate handgrips may be employed with the device of FIG. 16.
Figure 19B:
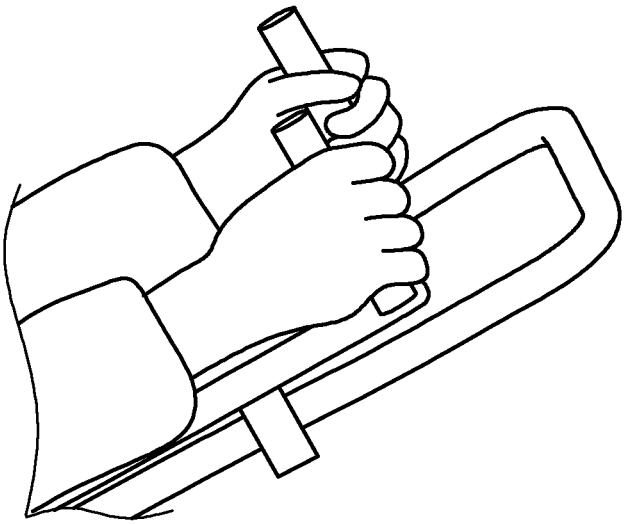
Figure 20A:
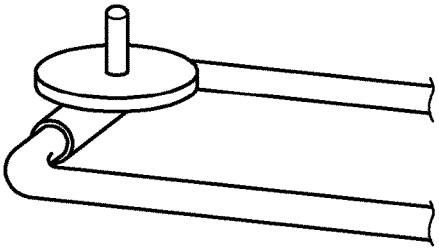
FIGS. 20A and 20B illustrate weights may be added to the device seen in FIG. 16.
Figure 20B:
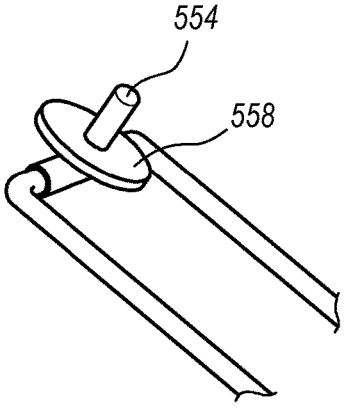

As seen in FIGS. 19A-19B, handgrips 552 may be disposed about the top 508 of the frame 502, wherein the handgrips 552 may be adjustable to a plurality of locations to fit different-sized users by means of incrementally-space mounting holes in the forearm support 540 and/or cross bar 542.

In another embodiment, a vertical post 554 may be mounted on base 504, upon which one or more weights 558 may be added for modifying leverage and momentum as the user rocks forward to stand. In the alternative or in combination therewith, the frame 502 may be constructed of tubular metal that is filled with a heavy material such as sand or water to provide weight that aids in getting the user upright.

Collapsibility of the device 500 may be achieved via the hinges 532, 534 placed about the bottom 510 of the device 500 and preferably at one end of the arcuate base 504. Clips 546 may be employed to maintain the device 100 in an upright position, as well as a stowed position. A strap 548 may also be used to keep the device 500 in a stowed position. When in use, a frictional strip 556 comprised of an anti-skid material may be placed on the bottom of the brace 504 to keep the device 500 in place during rocking or the like.

Once adjusted, the device 500 permits the user to stand up from a seated position or vice versa using leg muscles, rather than arm muscles that are typically far weaker than leg muscles. For example, when using the device 500 to stand, the configuration of the device 500 permits the user to have their hands grip near the top 508 of the device 500 and rock it forward until the user finds their body over their feet, resulting in the perfect position to stand up without assistance, as seen in FIGS. 22A-22E.

It should now be apparent the disclosed device 500 is also lightweight, portable, and inexpensive in comparison to many other devices. As such, it may be used in different places and circumstances: rising from a chair, sofa, toilet, bed, or the like. The device 500 may also be used in reverse, enabling the user to descend in a controlled manner into a seated position.

The device 500 advantageously permits the user to shift their center of gravity forward, using the user's own momentum and that of the device 500, to the optimum position from which to stand. The momentum is initiated by a rocking motion facilitated by the arcuate section of the base 504. The flat section of the base 504 stops the rocking, permitting the user to stand erect.

Once the user is in the correct forward position, it is then much easier to achieve the vertical standing position with leg muscles with little or no assistance from arm muscles. The device 500 also provides stability for the user when in the standing position. The device 500 may thus be used by a person in their own home, providing independence of living for longer than otherwise may have been possible.

As the device 500 is collapsible, it may therefore be taken to other locations for visiting, such as a grandchild's home. In a similar manner, the device 500 may also be used in hospitals, nursing homes, assisted living homes, rehabilitation centers, or the like where staff may use the time previously taken to assist people to rise from their chair in more profitable ways. Furthermore, the device 500 may reduce the amount of back injury frequently sustained by support staff when helping people to stand from a chair.

The device 500 may furthermore be used in the rehabilitation of persons who have diminished capability to stand from a seated position due to muscle atrophy, injury, or other conditions in which mobility could be improved with physical therapy with use of this disclosed invention.

Although certain embodiments have been described, the embodiments have been presented by way of example only and are not intended to limit the scope of the invention. Indeed, the mobility devices disclosed herein may be embodied in a variety of other forms. Furthermore, various omissions, substitutions, and changes in the form of the disclosed elements may be made without departing from the spirit of the invention.

The invention claimed is:

1. A mobility device comprising:

a frame having a left front leg, an opposing right front leg, a left rear leg, and an opposing right rear leg; and one or more boosters disposed about the left rear leg or right rear leg, the booster comprising a housing, a top support extending upward from the housing, and an opposing bottom support extending downward from the housing, wherein the housing contains a sleeve having a top channel in communication with an opposing bottom channel, wherein the top channel is configured to receive the top support, and wherein the bottom channel is configured to receive the bottom support, a retaining ring, and a spring.

2. The mobility device of claim 1, wherein the spring is disposed between a floor of the bottom channel and the retaining ring.

3. The mobility device of claim 1, wherein the housing contains a sleeve having a socket configured to receive a roller, and wherein the roller has a bottom hole configured to receive the top support.

4. The mobility device of claim 3, wherein the roller further includes a central hole configured to receive a pin, and wherein the top support further includes a roller slot configured to receive the pin.

5. The mobility device of claim 1, wherein the bottom channel has a floor, and wherein the bottom channel is further configured to receive the retaining ring and the spring.

6. The mobility device of claim 5, wherein the spring is disposed between the floor and the retaining ring.

7. The mobility device of claim 1, wherein the top support comprises an outer tube configured to receive an inner tube, wherein the outer tube has one or more holes configured to receive a pin disposed on the outer tube.

8. The mobility device of claim 7, wherein the inner tube includes a handgrip at one end opposite the housing.

9. The mobility device of claim 1, wherein the bottom support is curved away from the rear legs, and wherein the bottom support includes an anti-slip material.

10. The mobility device of claim 1, wherein the housing includes mounting means for coupling the booster to the frame.

11. A mobility device comprising:

a housing including a sleeve;

a top support extending upward from the housing; and an opposing bottom support extending downward from the housing, wherein the sleeve includes a top channel and an opposing bottom channel, wherein the top channel is configured to receive the top support, and wherein the bottom channel is configured to receive the bottom support, a retaining ring, and a spring, wherein the spring is disposed between a floor of the bottom channel and the retaining ring.

12. The mobility device of claim 11, wherein the sleeve includes a socket configured to receive a roller, and wherein the roller has a bottom hole configured to receive the top support.

13. The mobility device of claim 12, wherein the roller further includes a central hole configured to receive a pin, and wherein the top support further includes a roller slot configured to receive the pin.

14. The mobility device of claim 11, wherein the top support comprises an outer tube configured to receive an inner tube, wherein the outer tube has one or more holes configured to receive a pin disposed on the outer tube.

15. A mobility device comprising:

a frame having a left front leg, an opposing right front leg, a left rear leg, and an opposing right rear leg; and one or more boosters disposed about the left rear leg or right rear leg, the booster comprising a housing, a top support extending upward from the housing, and an opposing bottom support extending downward from the housing, wherein the housing contains a sleeve having a socket configured to receive a roller, and wherein the roller has a bottom hole configured to receive the top support.

16. The mobility device of claim 15, wherein the roller further includes a central hole configured to receive a pin, and wherein the top support further includes a roller slot configured to receive the pin.

17. A mobility device comprising:

a housing including a sleeve;

a top support extending upward from the housing; and an opposing bottom support extending downward from the housing, wherein the sleeve includes a top channel and an opposing bottom channel, wherein the top channel is configured to receive the top support, and wherein the bottom channel is configured to receive the bottom support, a retaining ring, and a spring, wherein the sleeve further includes a socket configured to receive a roller, and wherein the roller has a bottom hole configured to receive the top support.

18. The mobility device of claim 17, wherein the roller further includes a central hole configured to receive a pin, and wherein the top support further includes a roller slot configured to receive the pin.

* * * * *